United States Patent [19]

Casson et al.

[11] 4,087,344

[45] May 2, 1978

[54] ELECTROLYTIC CELL

[75] Inventors: Harold Vincent Casson, Napanee, Canada; Richard Eric Loftfield, Chardon, Ohio

[73] Assignee: Huron Chemicals, Ltd., Canada

[21] Appl. No.: 697,158

[22] Filed: Jun. 17, 1976

[51] Int. Cl.[2] ..... C25B 15/08; C25B 9/00

[52] U.S. Cl. ..... 204/239; 204/270; 204/278

[58] Field of Search ..... 204/275, 237, 239, 277, 204/278, 269, 270, 263, 265, 266, 257, 258

[56] References Cited

U.S. PATENT DOCUMENTS

| | | | |
|---|---|---|---|
| 3,819,503 | 6/1974 | Casson et al. | 204/278 |
| 3,925,186 | 12/1975 | Giacopelli | 204/258 X |
| 3,997,414 | 12/1976 | Casson et al. | 204/278 X |

*Primary Examiner*—Howard S. Williams
*Assistant Examiner*—D. R. Valentine
*Attorney, Agent, or Firm*—Stevens, Davis, Miller & Mosher

[57] ABSTRACT

An electrolytic cell is provided which is particularly suitable for the production of oxy-halogen compounds such as sodium chlorate by the electrolysis of an alkali metal halide such as sodium chloride. A removable casing divides the cell into a separate cell chamber and a cooling and concentration chamber outside of said casing; means are provided for the circulation of the electrolytic solution between the cooling and concentration chamber and the cell chamber, but there is a substantial seal against the passage of gas from one to the other. Gas such as hydrogen is separately removed from the interior of the casing, a gas sweep is provided across the surface of the electrolyte in the cooling and concentration chamber to cool the electrolyte and evaporate part of it so as to concentrate it. In accordance with this invention, such can be accomplished without danger of explosion. The removable casing achieves the desired separation into the cell chamber and cooling and concentration chamber while not restricting convenient access to the cells.

5 Claims, 4 Drawing Figures

ELECTROLYTIC CELL

BACKGROUND OF THE INVENTION

Present systems for producing products such as sodium chlorate by the electrolysis of sodium chloride solutions may generally be classified in the following groups:

(a) Bipolar cells placed in large tanks;

(b) Small monopolar cells.

Both of these systems have inherent disabilities. The bipolar cells which are situated in a large tank of electrolyte, are generally swept with air to dilute the evolved hydrogen below the explosive limit, generally 50 volumes of air for each volume of hydrogen. This combined air-hydrogen stream contains small particles of sodium chloride and sodium chlorate, and because of the large volume involved it is very difficult to effectively scrub out these particles. Because of the configuration of the cells it is difficult to direct the air stream to obtain adequate contact between the air and the solution and to achieve sufficient evaporation which would result in cooling and concentration of the solution. For this reason large quantities of cooling water are needed and large expensive heat transfer surfaces are involved. Due to insufficient concentration of the solution this must be sent through an evaporator for further concentration prior to use in any of the standard chlorine dioxide generators. This requires more energy usually in the form of steam.

The small monopolar cells also have their inherent difficulties. Each small cell must have either its individual acid and electrolyte feed and individual cooling or the electrolyte from many cells must be circulated to a large reaction tank and heat exchanger. This, of course, requires extra equipment and energy for pumping. In this procedure no air is swept across the electrolyte to cause evaporation, cooling and concentration, therefore this system also requires large quantities of cooling water and large heat transfer surfaces and in addition the solution requires further concentration before it is suitable for chlorine dioxide generator feed.

In pending U.S. application Ser. No. 574,391 filed May 5, 1975 for an invention of Harold V. Casson, Richard E. Loftfield and Bruno Kindl, an electrolytic cell was described in which there was a cell chamber containing an electrode assembly of anodes and cathodes to electrolyze an electrolytic solution to generate a dissolved product and a gas. This gas is separately removed from the cell chamber. A cooling and concentration chamber, which, as known in this art, acts also as a reaction chamber where hypoxyhalides convert to halates, is also provided and this communicates with the cell chamber to allow for the free or forced circulation of electrolytic solution. However, there is a substantial seal against the passage of gas from one chamber to the other. A gas sweep is directed through the cooling and concentration chamber to cool the electrolyte and evaporate part of the electrolyte so as to concentrate it.

It has, however, been found that with the structure described in the application referred to above, there was a problem in providing access without undue difficulty to the cells, while making certain that there was a minimum risk of explosion as a consequence of the leakage of hydrogen from the cell chamber into the cooling and concentration chamber. The flammability limit of hydrogen in air is 4% by volume. There can also be an explosion at the opposite extreme of air in hydrogen mixtures if there is more than 25.8% of air in hydrogen (Handbook of Chemistry and Physics 54th Ed. 1973–74 pages D85–86, Chemical Rubber Company). It will therefore be apparent that there could be a danger of explosion in the event of a slight leakage.

SUMMARY OF THE INVENTION

An object of this invention is to provide an electrolytic cell and a method of operating such cell that results in a low consumption of total energy.

A further object of this invention is to utilize the heat of the electrolyte developed during electrolysis in its evaporation and concentration.

Another object is to cool the electrolyte by the same means used to evaporate and concentrate the electrolyte, thereby reducing the need for auxiliary cooling.

Another object is to minimize the quantity of gas that should be scrubbed to remove particles of solid and liquid product.

A further object in its application to the sodium chlorate plant is to provide an electrolyte that has been evaporated and concentrated so as to be suitable as a feed for chlorine dioxide generator.

Another object of the invention is to achieve the foregoing while providing a positively sealed enclosure to contain the hydrogen gas.

A further object of this invention is to provide access to the cells without disassembly or danger of incorrect reassembly of any junctions of the positively sealed enclosure.

Another object of the invention is to provide an enclosure that contains the $H_2$ gas as it is flowing out of the electrode assembly with the electrolyte liquor.

A further object of the invention is to provide an enclosure to collect $H_2$ gas with the smallest possible volume.

Another object of the present invention is to provide a casing that is not rigidly connected with the cell tank and at the same time offers a gas tight seal of the $H_2$ gas contained in the casing.

A further object of the invention is to provide a means of separating the electrical conductors that feed energy to the electrode assembly from the $H_2$ gas.

Another object of the present invention is to prevent the mist laden $H_2$ gas from coming in contact with parts of the cell assembly such as the metal bars feeding electric current to the electrodes assembly and depositing wet and very corrosive salt crystals.

These and other objects and advantages of the invention are in summary, achieved by providing an electrolytic cell adapted to contain an electrolytic solution and having an electrode assembly of anodes and cathodes adapted to electrolyze said electrolytic solution to generate a dissolved product and a gas, a removable casing placed over said electrode assembly to receive said gas and to divide said cell into a separate cell chamber within said casing and a cooling and concentration chamber outside of said casing, at least one conduit communicating between said cell chamber and said cooling, evaporation and concentration chamber for the circulation of electrolytic solution from the cell chamber to the cooling and concentration chamber, at least one conduit communicating between said cooling and concentration chamber and said cell chamber for the circulation of electrolytic solution from the cooling and concentration chamber to the cell chamber, each of said conduits being below the level of the electrolytic solution in at least one of said chambers to avoid the passage of gas between the chambers and said chambers being sealed against the passage of gas from one to the other, means for removing said gas from the interior of said casing, inlet and outlet means for producing a gas sweep through the cooling and concentration chamber across the surface of the electrolyte in such chamber to cool the electrolyte and evaporate part of said electrolyte so as to concentrate it, means for introducing fresh electrolytic solution into said electrolytic cell and means for removing solution containing the dissolved product.

DESCRIPTION OF THE PREFERRED EMBODIMENTS

Figure 1:
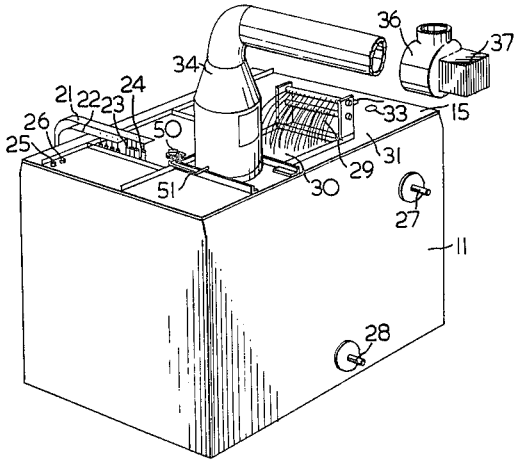
FIG. 1 is a perspective view of the exterior of an electrolytic cell in accordance with this invention.
Figure 2:
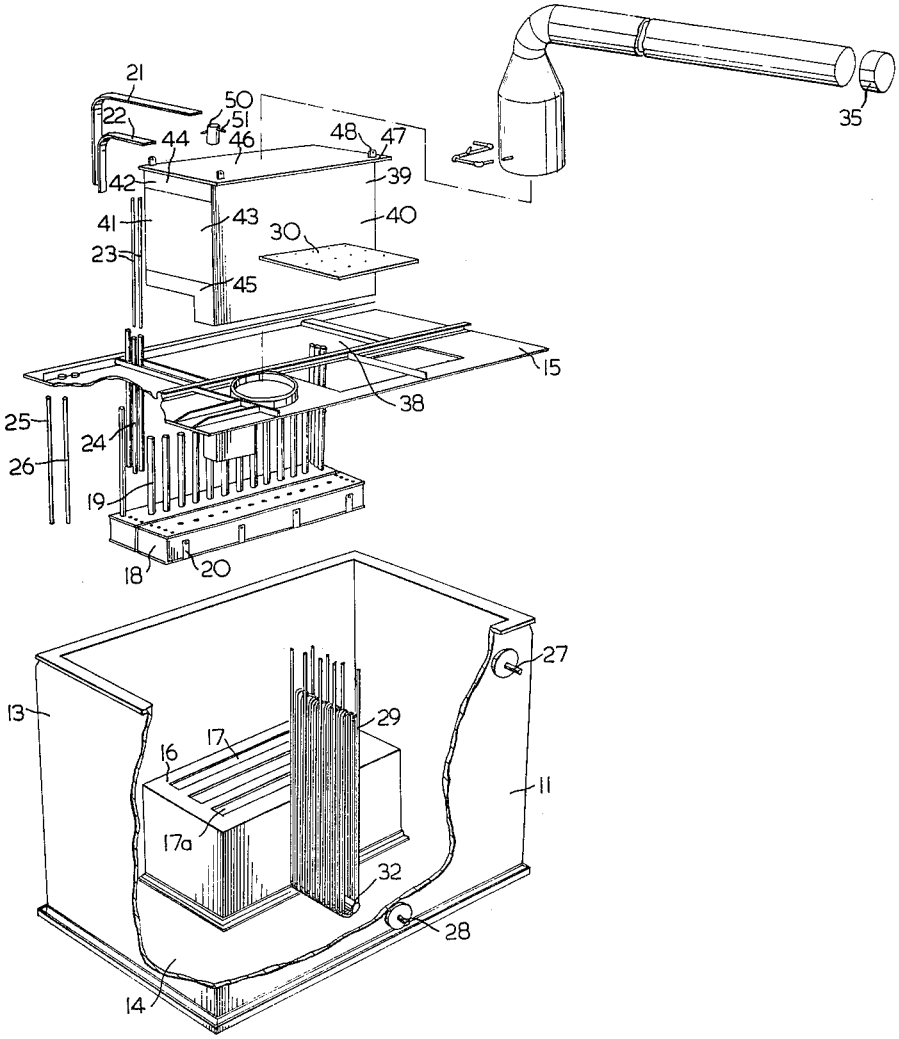
FIG. 2 is an exploded view showing the interior of the cell of FIG. 1 and the components of such cell.

In the embodiment illustrated in FIGS. 1 and 2 the electrolytic cell comprises a rectangular container formed by side walls 10 and 11, end walls 12 and 13, base 14 and top 15. Within such container there is a cell box table 16 slotted as at 17 to accommodate cell boxes 18. Such cell boxes are provided with conduits 19 for the outflow of electrolyte from the interior of the cells and inflow conduits (not shown). Suitable cells are more fully described in Casson et al U.S. Pat. No. 3,819,503 dated June 25, 1974. It is convenient to include lifting straps 20 to facilitate raising the cells when necessary. Appropriate electrical connections are provided for the cells, including bus bar connectors 21 and 22, which are joined to riser rods 23 contained within insulating riser rod sleeves 24. There will also be feed lines 25 and 26 for supplying acid and water to the cells.

The container will include an inlet port 27 for the admission of brine and a drain valve 28 to permit the removal of electrolyzed liquor. Cooling coils 29 are suspended from cooling coil cover 30 and communicate with cooling headers 31. It is convenient to provide a coil positioning weight 32 at the base of the cooling coils.

Top 15 of the main container is provided with air inlet apertures 33 adjacent to one end and exhaust duct 34 connected by flexible coupling 35 to exhaust fan 36. Exhaust fan 36 is driven by motor 37. There is thus provided an air sweep across the surface of the electrolyte which results in less cooling coils 29 being required and gives at the same time a concentration of the electrolytic solution. A rectangular opening 38 is provided in top 15 between the opposing sets of riser rod sleeves 24 and directly above cell boxes 18 to receive removable casing 39. Casing 39 comprises side walls 40 and 41 and end walls 42, at least one of which has an opening as indicated at 43 for the circulation of electrolyte from the interior to the exterior of casing 39. Wall 42 includes, however, an upper section 44 which extends below the normal liquid level of the electrolyte to prevent hydrogen from escaping into the exterior part of the container. The lower portion of wall 42 is stepped as indicated at 45 to receive cells 18. Casing 39 has no base. It can therefore be dropped into position to fit against cells 18. Electrolytic solution can enter cells 18 through suitable holes in their bottom plates after flowing through slot 17*a* which communicates with a hollow interior of cell box table 16 and hence with slots 17.

The lid 46 of casing 39 preferably has an overhang as indicated at 47 which will abut against the surface of top 15. Lifting lugs 48 may be provided for convenience in raising casing 39 for access to cell boxes 18. The side walls 40, end walls 42 and lid 46 of casing 39 are permanently joined together by welding or other suitable means to avoid danger of the escape of hydrogen through an accidental loose connection. Hydrogen is extracted from the interior of casing 39 through port 49 which is fitted with hydrogen demister 50 to which is connected hydrogen line 51 which leads to conduit 34. It will be apparent that access can be obtained to the cell boxes by disconnecting hydrogen line 51 from demister 50 and lifting casing 39 using lugs 48. There will be no need to disconnect and subsequently reconnect seals at which leakage might occur to create the danger of an explosion.

Figure 4:
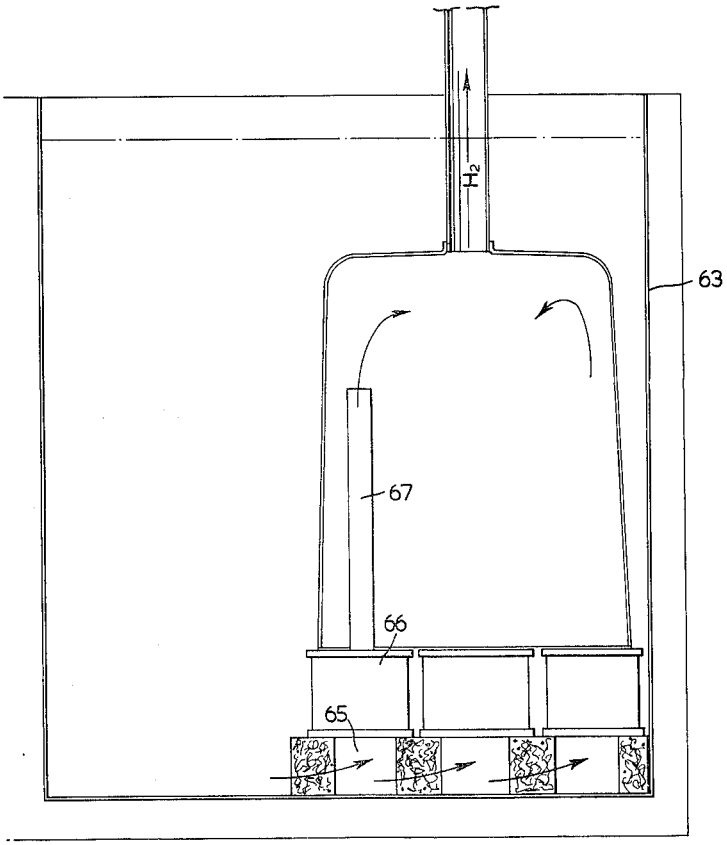
FIG. 4 is an end elevation view of the embodiment shown in FIG. 3.
Figure 3:
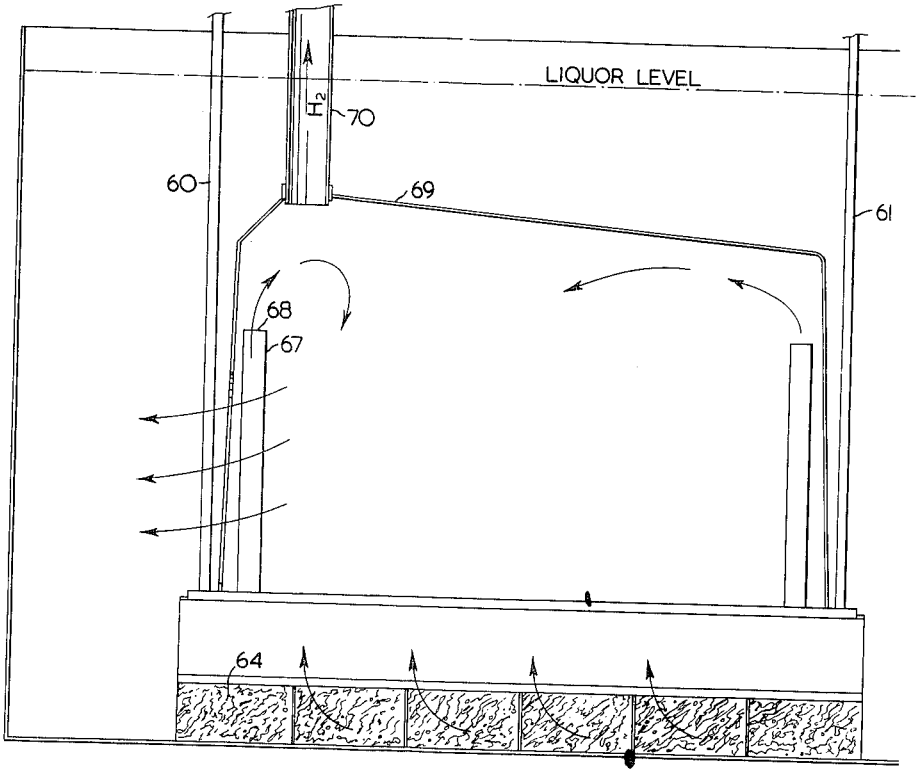
FIG. 3 is a side elevation view illustrating an alternative embodiment of this invention.

FIGS. 3 and 4 illustrate a modification in which the casing providing a hydrogen box is completely immersed below the level of the liquor. In this embodiment the outer container has end walls 60 and 61 and side walls 62 and 63. A cell table is provided by bricks 64 which are arranged in rows to leave passages 65 for the admission of liquor to cells 66. Preferably, the conduits 67 communicating with the interior of cells 66 have exit apertures 68 above the level of the top of inlet 68. Casing 69 has an open bottom so that it can be lowered into position as described in connection with FIGS. 1 and 2. Conduit 70 is connected to the interior of casing 69 for the removal of hydrogen.

In each of the embodiments it is preferred that a slight positive pressure of hydrogen be maintained within the casing 39 or 69 to keep air out and avoid collecting a potentially explosive mixture. The embodiment of FIGS. 3 and 4 has the advantage of permitting the hydrogen to be piped off without the necessity of containing a volume of gas at the top of the hydrogen box.

Although the main container and also the hydrogen box have been illustrated as being rectangular in shape, it will be appreciated that it would be possible to use other configurations such as a circular configuration. Other variations are possible, for example, it may be advisable to pass the hydrogen collected above the cells through a short labyrinth of baffles before it is piped off to assist in extracting unnecessary liquid from the hydrogen.

The saving of power achieved in accordance with this invention will be evident from the examples of U.S. application Ser. No. 574,391. Such examples also supply further information as to the use of the apparatus of this invention. These advantages are obtained with the substantial elimination of any possibility of an explosive mixture of hydrogen and air being formed, while at the same time convenient access to the cells is provided.

We claim:

1. An electrolytic cell adapted to contain an electrolytic solution and having an electrode assembly of anode and cathodes adapted to electrolyze said electrolytic solution to generate a dissolved product and a gas, and including conduits for the outflow of electrolyte from the electrode assemblies and including also riser rods located laterally of the electrode assemblies electrically to connect bus bars to the electrode assemblies a removable casing placed over said electrode assembly between said riser rods to receive the electrolytic solution containing said dissolved product and said gas and to let electrolytic solution and gas separate inside said casing and to divide said cell into a separate cell chamber within said casing and a cooling and concentration chamber outside of said casing, said casing being arranged so that it can be raised free of the electrolytic cell without interference from said bus bars at least one conduit communicating between said cell chamber and said cooling, evaporation and concentration chamber for the circulation of electrolytic solution from the cell chamber to the cooling and concentration chamber, without the circulation of gas between said chambers at least one conduit communicating between said cooling and concentration chamber and said cell chamber for the circulation of electrolytic solution from the cooling and concentration chamber to the cell chamber, without the circulation of gas between said chambers and said chambers being sealed against the passage of gas from one to the other, means for removing said gas from the interior of said casing, inlet and outlet means for producing a gas sweep through cooling and concentration chamber across the surface of the electrolyte in such chamber to cool the electrolyte and evaporate part of said electrolyte so as to concentrate it, means for introducing fresh electrolytic solution into said electrolytic cell and means for removing solution containing the dissolved product.

2. An electrolytic cell as in claim 1 including means for combining gas evolved in said cell chamber with the outlet means of the gas sweep while avoiding an excess over the flammability limit of hydrogen in air.

3. An electrolytic cell as in claim 1 in which said inlet and outlet means are arranged substantially at opposite ends of the cooling and concentration chamber to produce a gas sweep that passes across substantially the entire surface of the electrolytic solution.

4. An electrolytic cell as in claim 1 in which the removable casing has an open bottom and is open at one end below the normal liquid level of the electrolyte to provide said one conduit.

5. An electrolytic cell as in claim 1 in which the removable casing is entirely immersed below the normal liquid level of the electrolytic solution.

* * * * *